US012558609B2

(12) United States Patent
Behmke et al.

(10) Patent No.: US 12,558,609 B2
(45) Date of Patent: Feb. 24, 2026

(54) RECONFIGURABLE BOARD GAME SYSTEM

(71) Applicants: Skylar D. Behmke, Boston, MA (US); James M. Behmke, Boston, MA (US)

(72) Inventors: Skylar D. Behmke, Boston, MA (US); James M. Behmke, Boston, MA (US)

( * ) Notice: Subject to any disclaimer, the term of this patent is extended or adjusted under 35 U.S.C. 154(b) by 897 days.

(21) Appl. No.: 17/835,610

(22) Filed: Jun. 8, 2022

(65) Prior Publication Data

US 2022/0387880 A1 Dec. 8, 2022

Related U.S. Application Data

(60) Provisional application No. 63/208,232, filed on Jun. 8, 2021.

(51) Int. Cl.
*A63F 3/00* (2006.01)

(52) U.S. Cl.
CPC ..... *A63F 3/0023* (2013.01); *A63F 3/00261* (2013.01); *A63F 3/00895* (2013.01); *A63F 2003/00239* (2013.01); *A63F 2003/00246* (2013.01); *A63F 2003/00347* (2013.01); *A63F 2003/00943* (2013.01)

(58) Field of Classification Search
CPC ..... A63F 3/00261; A63F 3/0023; A63F 3/00895; A63F 3/00533; A63F 2003/00239; A63F 2003/00246; A63F 2003/00347
See application file for complete search history.

(56) References Cited

U.S. PATENT DOCUMENTS 1,914,001 A * 6/1933 Warshay ..... B42D 3/14 116/239
2,872,215 A * 2/1959 Taylor ..... A63F 3/0625 273/287
8,770,584 B1 * 7/2014 Miravete ..... A63F 1/02 434/428
2004/0066031 A1 * 4/2004 Wong ..... B42F 7/04 281/31
2007/0167216 A1 * 7/2007 Walker ..... G07F 17/3239 463/18
2014/0346217 A1 * 11/2014 Nielsen ..... B42F 7/065 229/67.1

(Continued)

*Primary Examiner* — James S. McClellan
(74) *Attorney, Agent, or Firm* — Lee & Hayes, P.C.

(57) ABSTRACT

A reconfigurable boardgame system herein comprises a reconfigurable boardgame board (e.g., four panel tri-fold) with a plurality of "page-retaining corner members" in corners of board panels, allowing interchanging customized boardgame pages. In one embodiment, only those corners of each panel that are exteriorly located on the board have corresponding corner members (leaving the center unobstructed). In another embodiment, the boardgame board is contained within a reconfigurable boardgame kit, which may comprise reusable (e.g., generic and shared) game pieces (dice, timers, pawns, etc.) for use by many games. In still another embodiment, the boardgame kit comprises blank and/or templated items to be filled in, such as boardgame panels, cards, customized dice, game pawn blanks, rules templates, etc. Envelopes may store the game panel pages, rules, and custom pieces of each individual boardgame, to be stored in the kit and used with the reconfigurable boardgame board and the generic reusable game pieces.

1 Claim, 16 Drawing Sheets

(56) References Cited

U.S. PATENT DOCUMENTS

| | | | | |
|---|---|---|---|---|
| 2015/0115528 | A1* | 4/2015 | Fiore | A63F 3/00261<br>273/142 R |
| 2021/0101072 | A1* | 4/2021 | Briggs | A63F 3/00261 |
| 2022/0258036 | A1* | 8/2022 | Garofalo | A63F 3/00643 |

* cited by examiner

RECONFIGURABLE BOARD GAME SYSTEM

RELATED APPLICATION

This application claims priority to U.S. Prov. Appl. Ser. No. 63/208,232, filed Jun. 8, 2021, entitled RECONFIGURABLE BOARD GAME SYSTEM, by Skylar D. Behmke, et al., the contents of which are incorporated herein by reference.

TECHNICAL FIELD

The present disclosure relates generally to board games, and, more particularly, to a reconfigurable board game system.

BACKGROUND

Board games have provided fun for families and friends for thousands of years, having been played and adapted in most cultures throughout history. Typically configured as tabletop games, one or more players generally move pieces (e.g., pegs, pawns, tokens, etc.) on a pre-marked "board" (e.g., actual wood, or most often cardboard in contemporary gaming) according to a set of rules with a competitive or collaborative goal to achieve to win the game (e.g., reach the end, obtain the highest score, capture the opponent's pieces, etc.). There are many varieties and themes of board games, and rules can range from the very simple to deeply complex. Gameplay and movement often involves dice, spinners, cards, challenges (e.g., timed), diplomacy (e.g., negotiation between players), and so on for players to move along a pre-defined course or map of the board (e.g., the "playing surface"). Some games depend completely on player skill, while many games require no decisions by the players and are decided purely by luck, and some games provide all information to the players in order to make decisions and strategy, and others hide certain information from the players to add probabilistic estimations or hypothesizing into the gameplay.

There are a plethora of ways in which board games can be classified, and considerable overlap may exist, so that a game belong in several categories. For example, the wide variety of game categories may include things such as: Abstract strategy games; Alignment games; Auction games; Chess variants; Configuration games; Connection games; Cooperative games; Count and capture games; Cross and circle games; Deduction games; Dexterity games; Economic simulation games; Educational games; Elimination games; Family games; Fantasy games; German-style board games or Eurogames; Guessing games; Hidden-movement games; Hidden-role games; Historical simulation games; Horror games; Large multiplayer games; Learning/communication non-competitive games; Mancala games; Multiplayer games; Musical games; Negotiation games; Paper-and-pencil games; Physical skill games; Position games; Race games; Role-playing games; Roll-and-move games; Running-fight games; Share-buying games; Single-player puzzle games; Spiritual development games; Storytelling games; Stacking games; Territory games; Tile-based games; Train games; Trivia games; Two-player-only themed games; Unequal forces (or "hunt") games; Wargames; Word games; and so on.

In addition, there is a dedicated field of research into gaming, known as game studies or ludology, which has shown that board games can be used to improve children's spatial numerical understanding and basic number skills (such as counting, recognizing numbers, numerical estimation, and number comprehension), as well as fine motor skills and executive functions. Moreover, boardgames have been shown to help reduce risks of dementia for the elderly. Not only that, but board games can be a viable addition to traditional educational curriculum. Of course, on the other hand, board games may simply be fun and/or therapeutic, and may help pass the time.

A myriad of new games are released every year, with only certain games becoming widely successful and living on from generation to generation. Knowing in advance which games will become a success, however, is a nearly impossible feat, and many games become quickly forgotten, filling the backs of closets or landfills. Furthermore, while board games are estimated to be a billion dollar industry worldwide, the Internet and cheaper home printing has influenced board games via "print-and-play" games that may be purchased online (or downloaded for free) and printed, competing with traditional "boxed" board games. Also, many creative people (both children and adults) enjoy making their own games at home, not only for the end result of their own designed game, but also because the process of designing a game can provide much of the enjoyment. At the same time, however, many people don't know where to start to design their own board game, or don't have the components needed to complete their games. Still further, regardless of whether the games are purchased, printed, or designed, and whether they are played often, rarely, or not at all, the storage of all of the different accumulated games can become problematic as storage space is often limited in many player's homes.

SUMMARY

The techniques herein are directed generally to a reconfigurable board game system. Specifically, in one embodiment, a reconfigurable board game board, which may be a tri-fold (four panels), bi-fold (two panels), or otherwise (e.g., six panels and so on), may comprise a plurality of "page-retaining corner members" in corners of each panel of the board, preferably sized and located to accommodate locally standard printer paper (e.g., letter sized, A4, etc.), allowing for the insertion, removal, and general interchange of customized board game pages (e.g., drawn, printed, purchased, or otherwise created). For example, the corner members/tabs may be adhered pockets, pockets created by slices in a game board surface, elastic bands, clips, and so on. In one embodiment, only those corners of each panel that are located on the exterior of the reconfigurable board game board have a corresponding corner tab (e.g., three exterior corners of each panel of a tri-fold board), leaving the center of the board open for unobstructed game play space.

In another embodiment, the board game board is contained within a reconfigurable board game kit. Specifically, in one embodiment, the kit comprises a plurality of different reusable (e.g., generic and shared) game pieces, such as dice, timers, spinners, pawns, cards, tokens, and so on, such that many different designed or printed games can make use of the same kit items. In still another embodiment, the board game kit comprises blank and/or templated items to be filled in, such as board game panels, cards, customized dice, game pawn blanks (and their holders/stands), rules templates, and so on. In a further embodiment, the kit comprises a number of envelopes and/or other containers to store the panels/pages of each individual board game, its corresponding rules, and any customized (generally non-generic/reusable)

game pieces, such that the game board kit can store a number of different games in a single smaller space, by reusing the reconfigurable board game board and the generic game pieces.

Other embodiments of the present disclosure may be discussed in the detailed description below, and the summary above is not meant to be limiting to the scope of the invention herein.

BRIEF DESCRIPTION OF THE DRAWINGS

The embodiments herein may be better understood by referring to the following description in conjunction with the accompanying drawings in which like reference numerals indicate identically or functionally similar elements, of which.

DESCRIPTION OF EXAMPLE EMBODIMENTS

As noted above, many people enjoy, or would enjoy, designing their own board games. Also, print-and-play games may be downloaded and printed at home.

The reconfigurable board game system according to the present disclosure, therefore, caters to this industry by providing a reconfigurable board game board that comprises a plurality of "page-retaining corner members" in corners of each panel of the board, allowing for the insertion, removal, and general interchange of customized board game pages (e.g., drawn, printed, purchased, or otherwise created).

Figure 1:
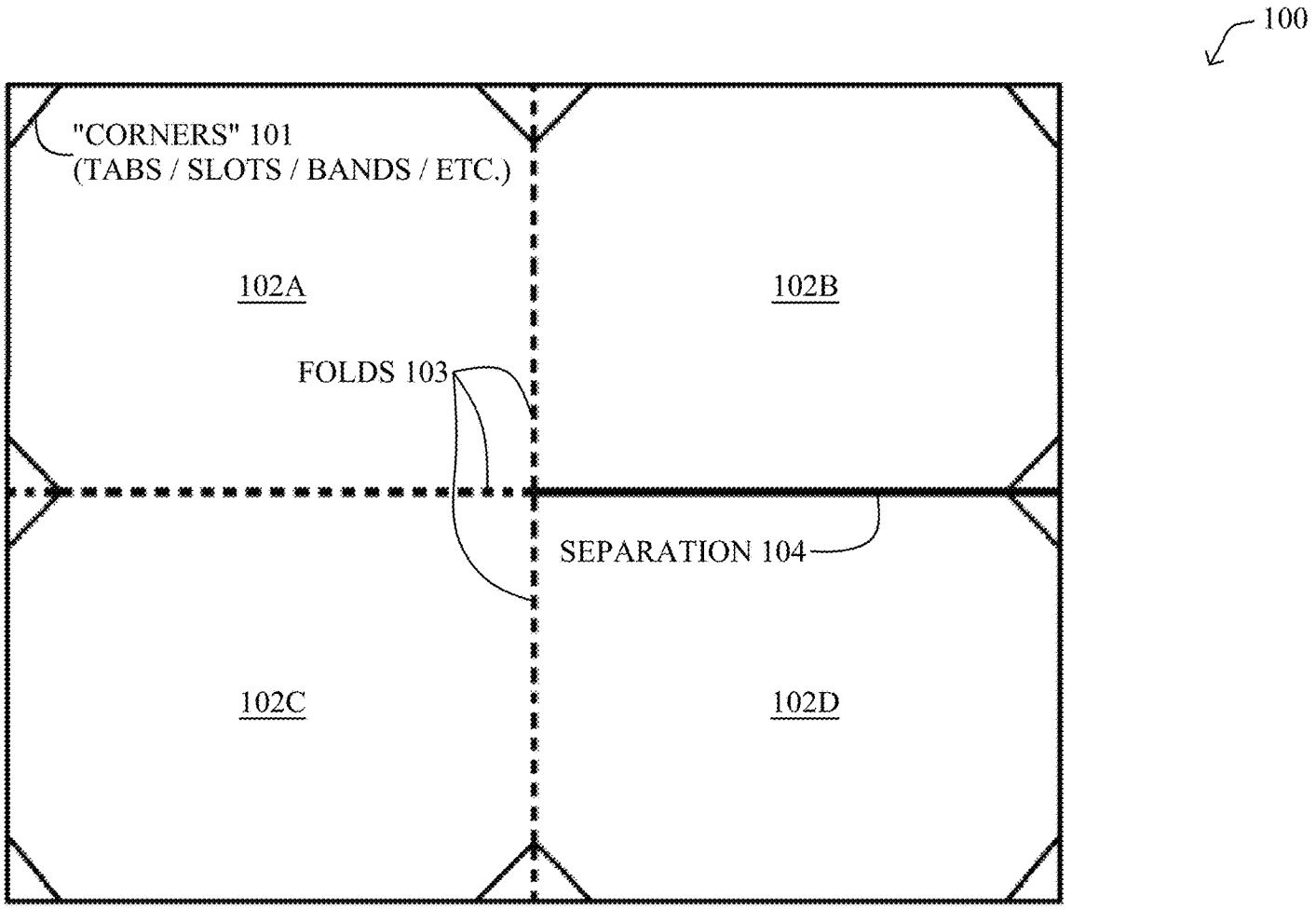
FIG. 1 illustrates an example of a reconfigurable board game board in accordance with one or more embodiments of the present disclosure.

FIG. 1 illustrates an example of a reconfigurable board game board 100 in accordance with one or more embodiments of the present disclosure. For example, the page-retaining corner members 101 are located in one or more corners of each of the plurality of panels 102, labeled in FIG. 1 as A, B, C, and D, where, as described below, the page-retaining corner members/tabs (or simply "corners") may be tabs, slots, bands, pockets, etc. The game board and panels can be made from any suitable material(s), such as a base of cardboard, plastic, wood, etc., and may or may not be covered by another surface material, such as vinyl, felt, paper, and so on.

Note that while the example game board in FIG. 1 is shown as a four-panel tri-fold design, other designs may be used, such as bi-folds (two panels), six-paneled boards, and so on (e.g., where each of the plurality of panels are interconnected to at least one adjacent panel of the plurality of panels by a corresponding folding interconnection). Also, as shown, the folds 103 of the game board are indicated by dashed lines (e.g., between panels A and B, between panels A and C, and between panels C and D), and the separation 104 or "cut" is shown as a solid line (e.g., between panels B and D).

Regarding placement of the corners/members 101, though every corner of every panel could have a respective page-retaining corner (i.e., four corners for each panel), in a preferred embodiment herein, only those corners of each panel that are located on the exterior of the reconfigurable board game board have a corresponding corner tab. That is, on the illustrative tri-fold board shown, only the three exterior corners of each panel have a corner piece, thus leaving the center of the board open for unobstructed game play space. Having three corners is sufficient to hold game pages/papers in place during game play while also leaving the center unobstructed. Two corners may also be used, or even one corner, however fewer corners results in less security of the inserted game pages. Note also that the number of corners may differ between panels (e.g., three corners on one panel, four corners on another, two corners on still another, and so on), and the precise number shown and described herein is not meant to limit the scope of the present invention.

Figure 2:
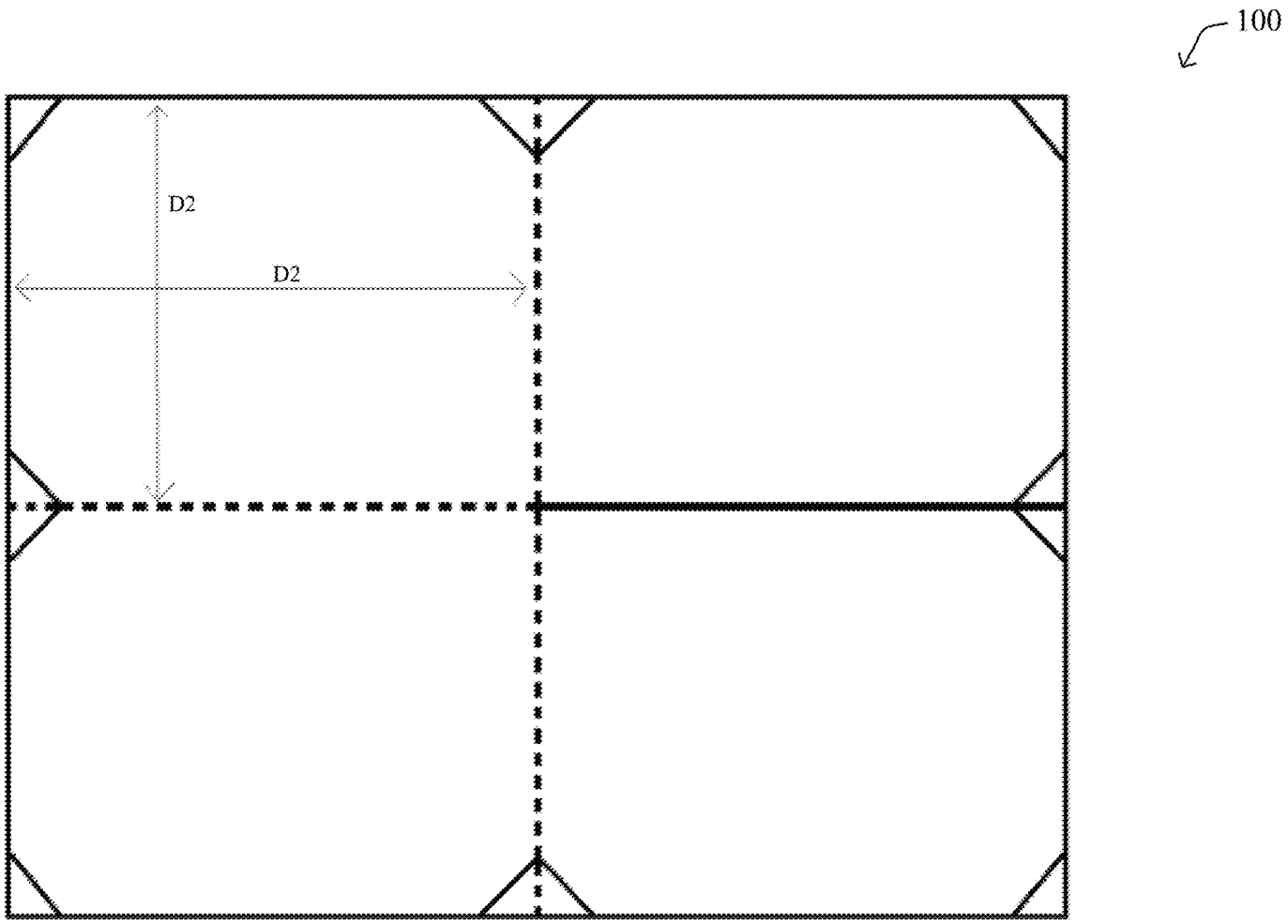
FIG. 2 illustrates an example of dimensions of a reconfigurable board game board in accordance with one or more embodiments of the present disclosure.

FIG. 2 illustrates an example of dimensions of a reconfigurable board game board 100 in accordance with one or more embodiments of the present disclosure. In one particular (e.g., preferred) embodiment herein, each panel, or more particular, the space defined by the locations of the corners, may be appropriately sized to accommodate a locally standard size of printer paper and/or construction paper. For example in the United States, the dimensions for "D1" and "D2" (D1×D2) may be a size that accommodates "letter" sized paper, thus 8.5×11 inches. For much of the rest of the world, however, D1 and D2 may correspond to the internationally standardized "A4" paper, thus 8.25×11.75 inches (210×297 mm). By configuring the size of the insertable area created by the locations of the corner supports that are standard to a particular region, the supply of paper available in most households is ready for creation of games and/or download and printing of games on a home printer without the need for specialty-sized paper. (Note, of course, that any sized paper may be used, and any dimensions of D1 and D2 may be used, and that the example dimensions given herein are a matter of thoughtful convenience rather than a requirement herein.)

Notably, in other embodiments, other shapes, in addition to rectangular panels and game boards (e.g., for standard-sized paper), may also be used herein, such as triangles, pentagons, hexagons, octagons, parallelograms, squares, rhombuses, or other polygons or non-polygons, and the shapes shown and described herein are not limiting to the scope of the embodiments herein. As such, the supplied paper (pre-designed, blank, templated, etc.), may also have a similar shape and size as the underlying panels. Also, the term "corner" herein need not imply a 90-degree corner, but merely any vertex or point where two edges of the panel meet, in any angular orientation as configured.

Figure 3A:
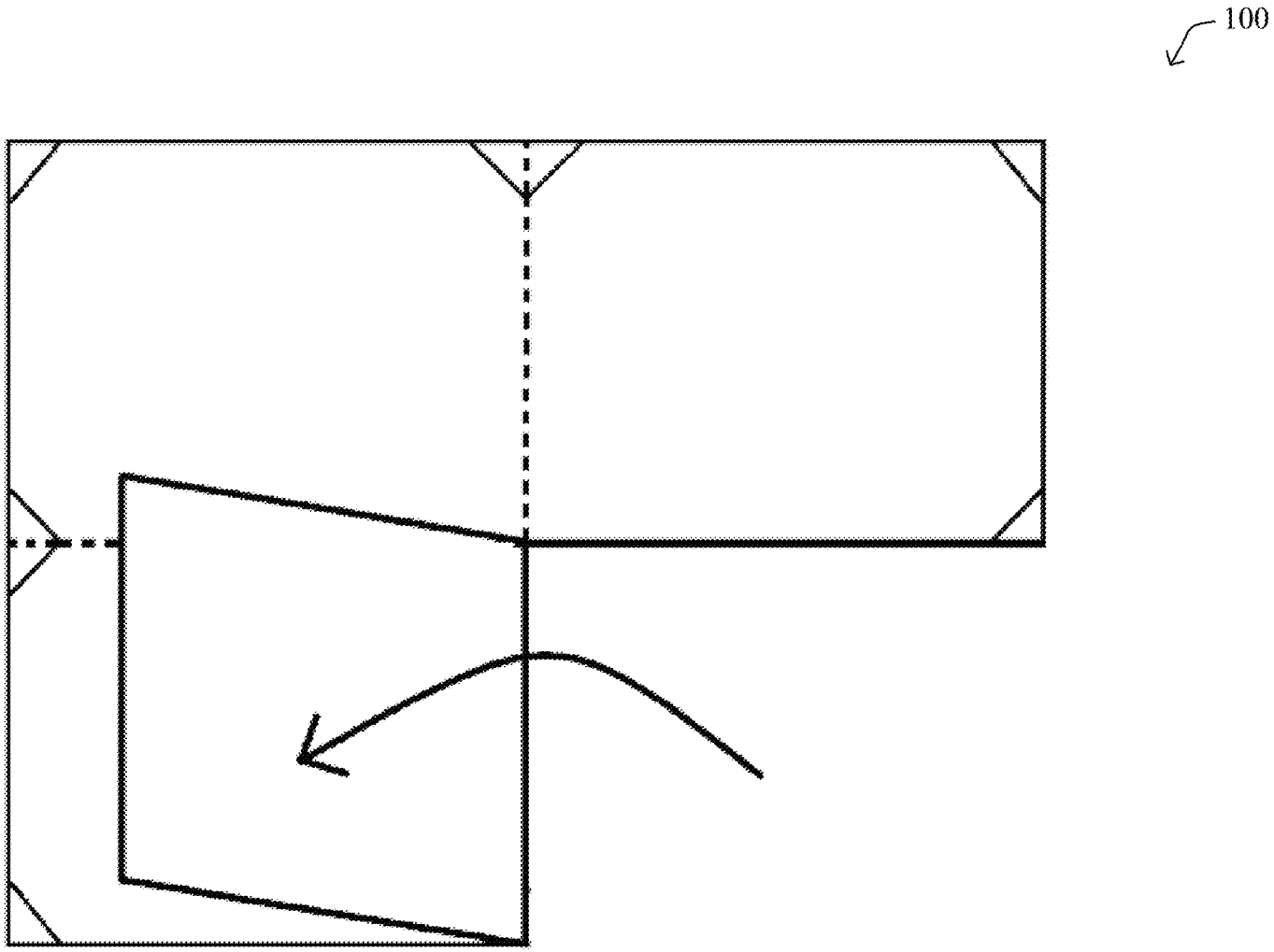
FIGS. 3A-3C illustrate an example of folding of a reconfigurable board game board in accordance with one or more embodiments of the present disclosure.
Figure 3B:
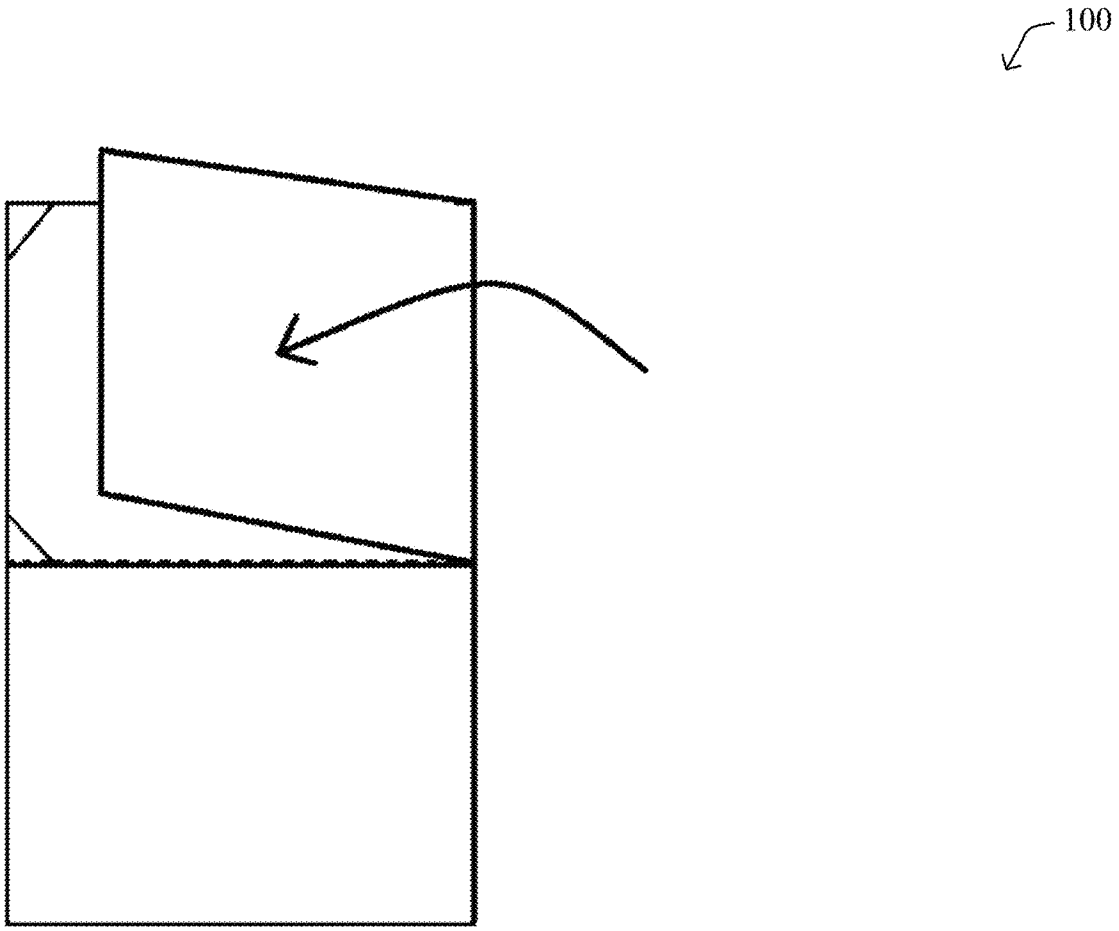
Figure 3C:
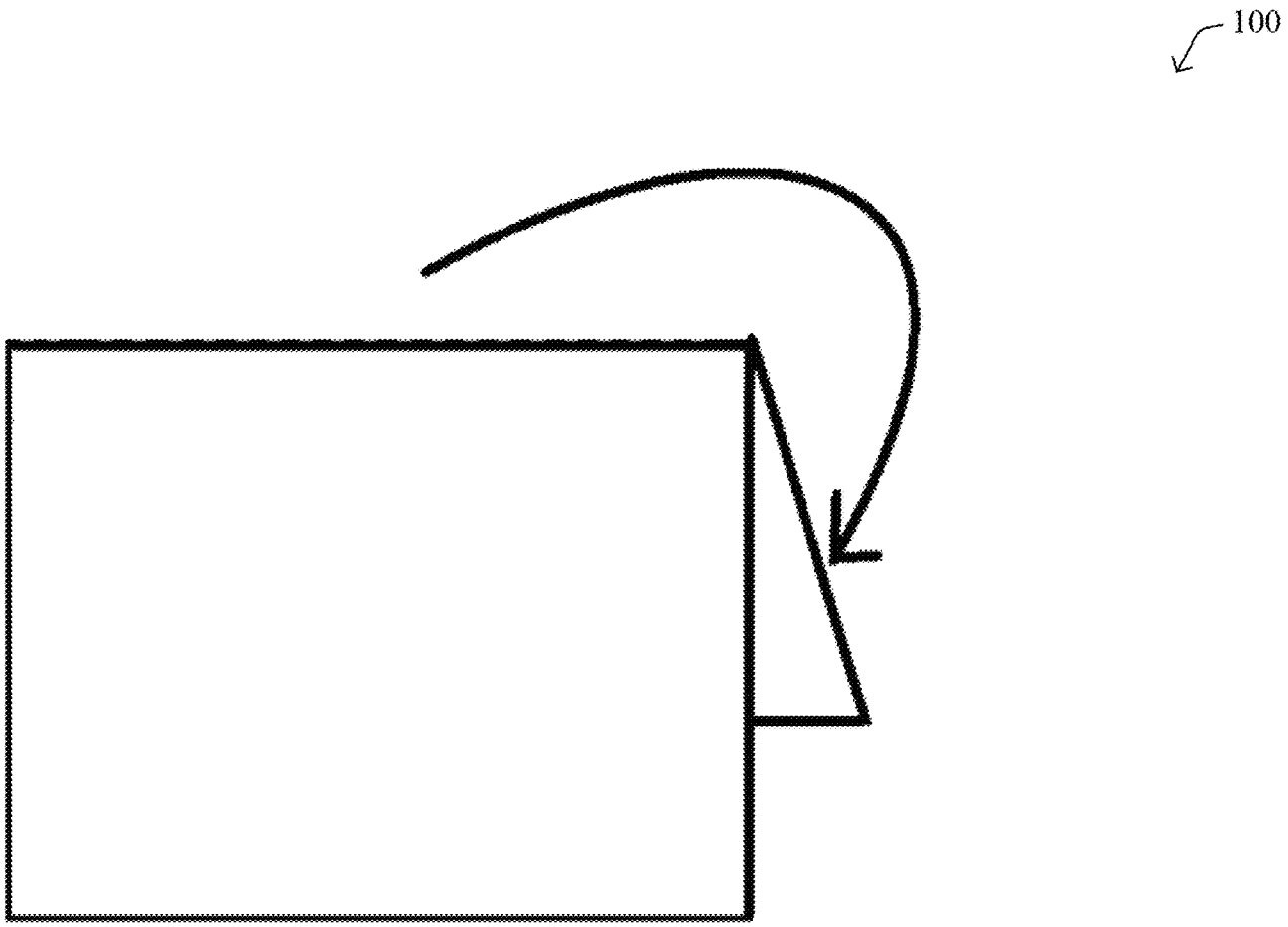

FIGS. 3A-3C illustrate an example of folding of a reconfigurable board game board 100 in accordance with one or more embodiments of the present disclosure. In particular, assuming the tri-fold design illustrated in FIG. 1, FIG. 3A illustrates how panel D can be separated from panel B and folded onto panel C, while FIG. 3B illustrates how panel B can similarly be folded onto panel A. As shown in FIG. 3C, the backs of panels A and C may then be folded together, as allowed by the split between panels B and D separating while folded over the A-C border. Illustratively, the page-retaining corner members 101 are shown as becoming "hidden" by the folding (i.e., become the inside portion of the folded board, protecting the corners), however the board and corners may be oriented to fold in the opposite directions, such that the corners are exposed. Those skilled in the art will also understand that the order and orientation of the folding is merely an example, and may differ depending upon the arrangement of the panels, folds, and separations.

Figure 4A:
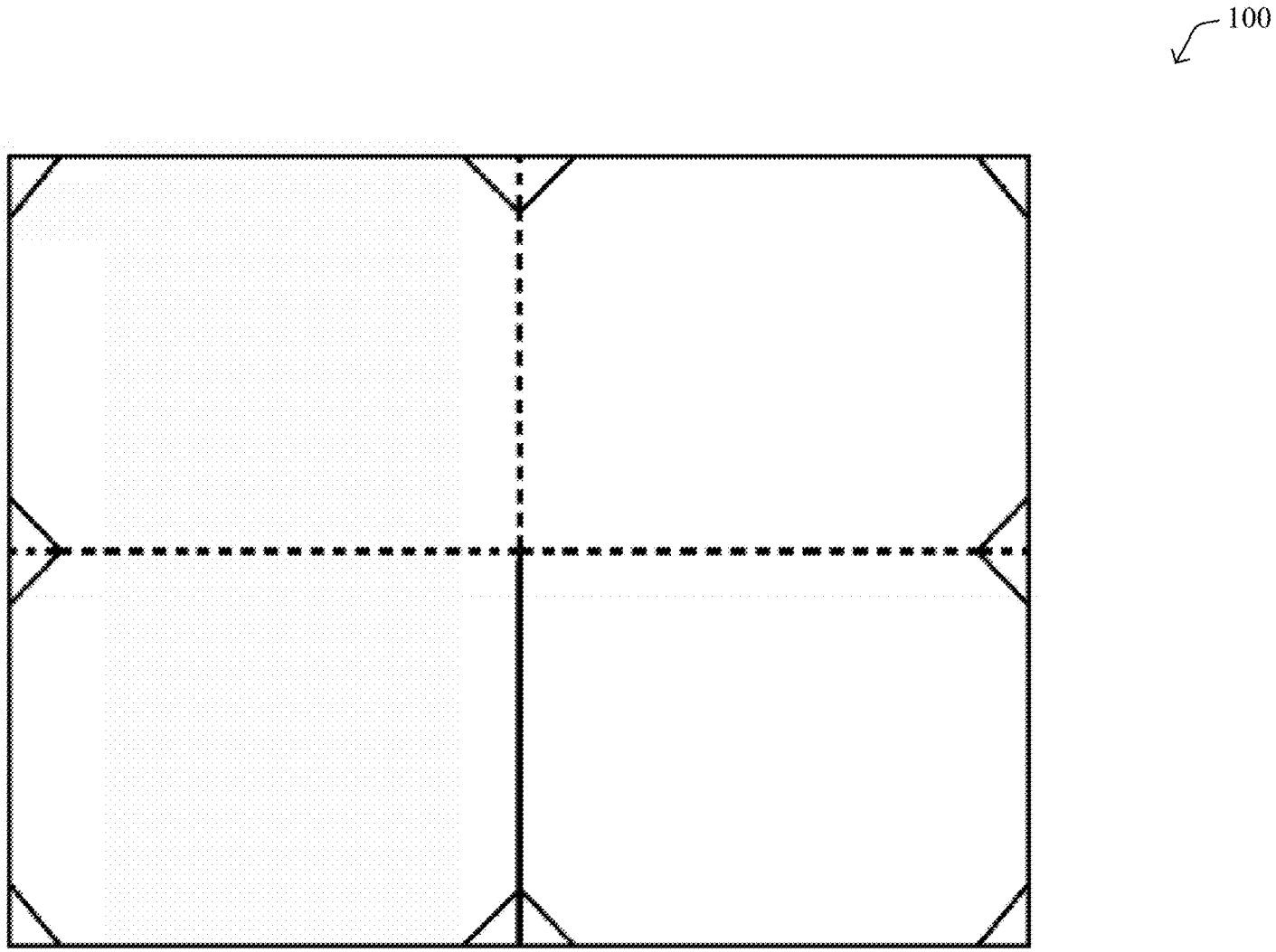
FIGS. 4A-4B illustrate an alternative example of folding a reconfigurable board game board in accordance with one or more embodiments of the present disclosure.
Figure 4B:
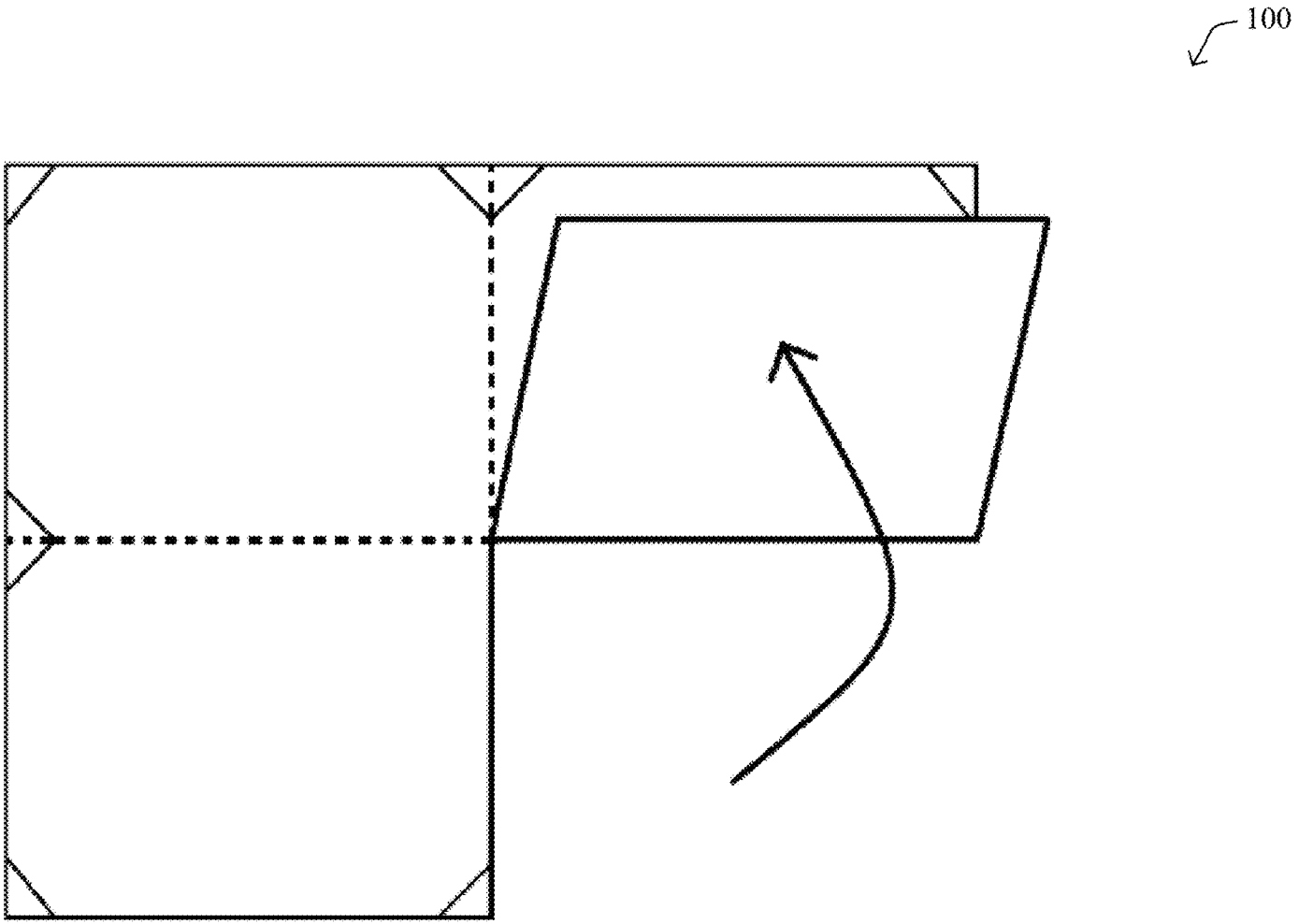

FIGS. 4A-4B, for instance, illustrate an alternative example of folding a reconfigurable board game board 100 in accordance with one or more embodiments of the present disclosure. In particular, as shown the board game board is now split on the shorter border between panels C and D, rather than on the longer border between panels B and D, as illustrated above. Here, as pictured in FIG. 4B, therefore, the initial folding may now be performed on the folding border between panels B and D, such that panel D folds on panel B, and so on, as will be understood by those skilled in the art.

Figure 5A:
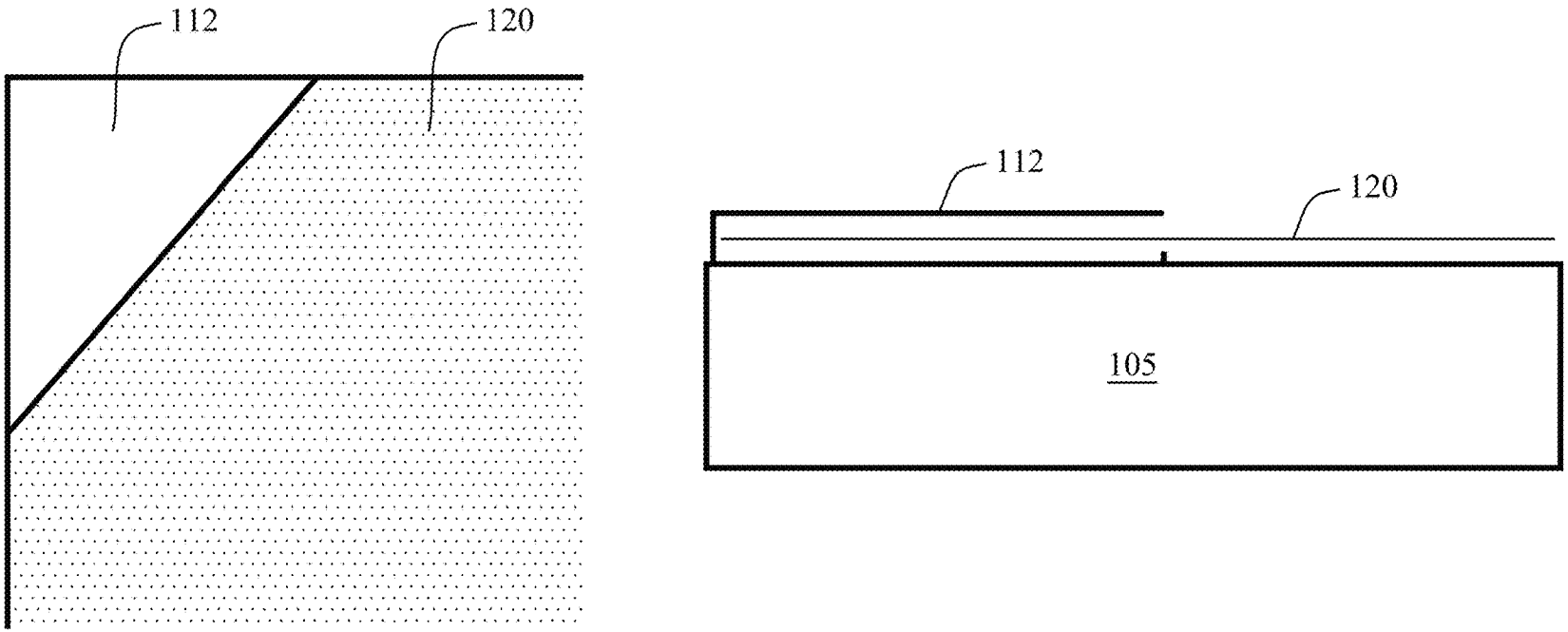
FIGS. 5A-5C illustrate an example of page-retaining corner tab configurations for a reconfigurable board game board in accordance with one or more embodiments of the present disclosure.
Figure 5B:
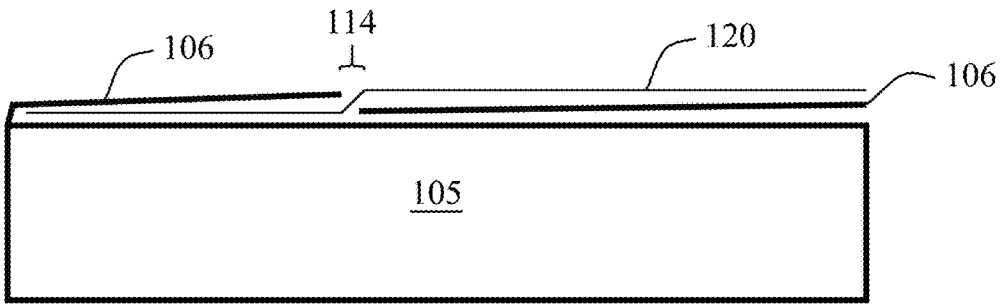
Figure 5B:
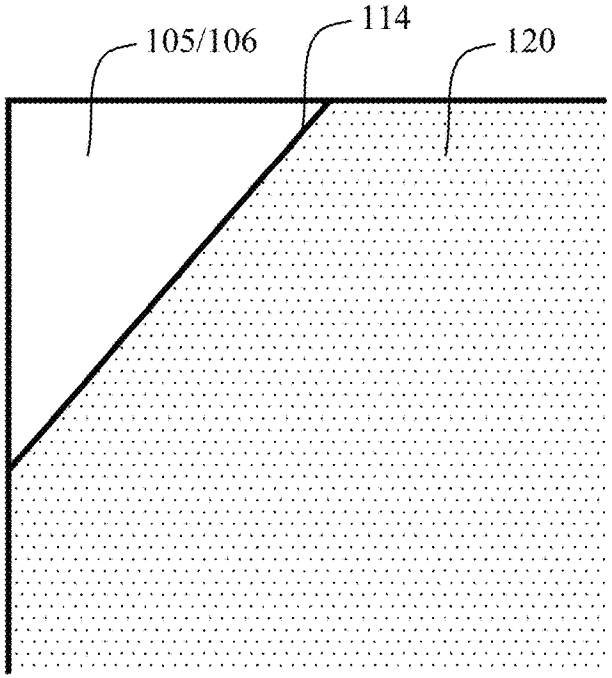
Figure 5C:
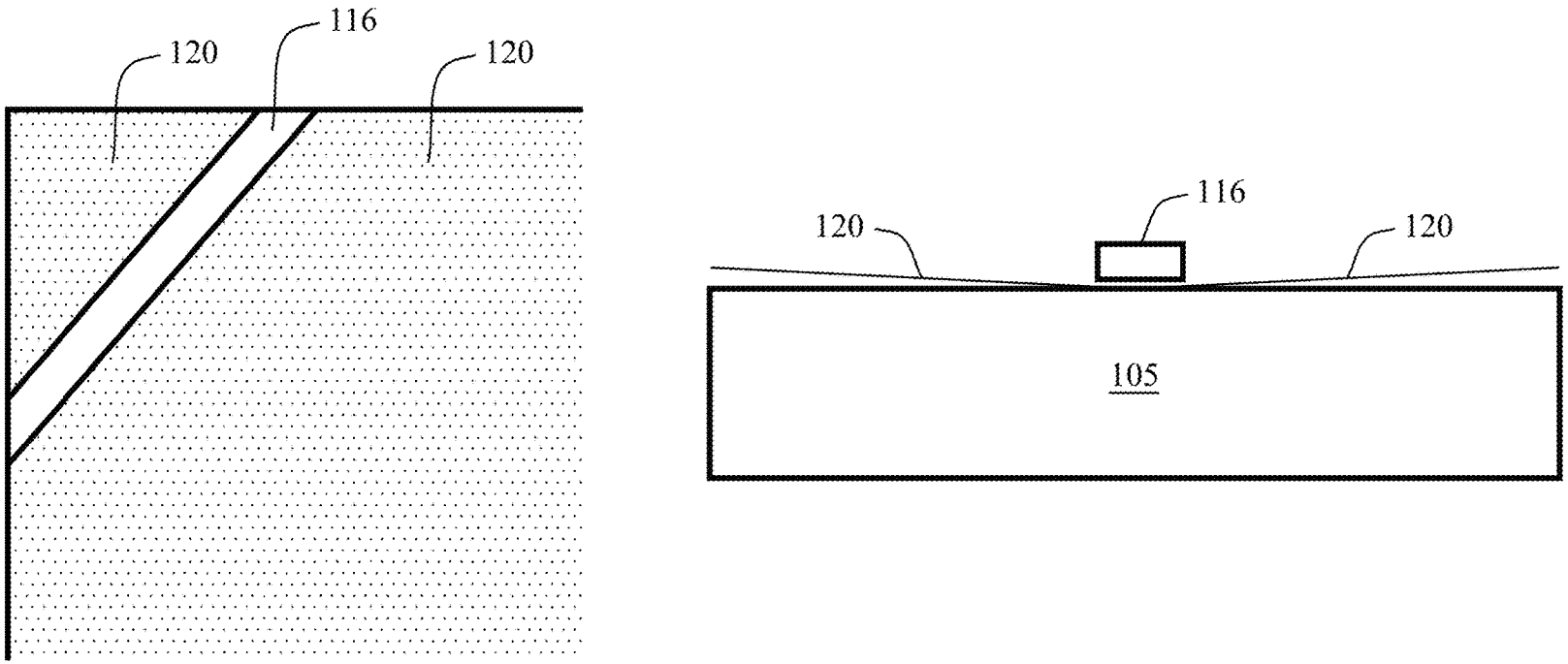

Turning now to FIGS. 5A-5C (each showing a fractional top view and side cutaway view), the page-retaining corner members 101 may comprise a number of different configuration options herein. For example, FIG. 5A shows the corners as adhered pockets 112 that have been placed onto the surface of the game board 105, such that the game page (paper) 120 can be inserted into each of the pockets 112 to secure the game page in place. As shown, the pockets may be adhered on top of the game board 105, though suitable alternative embodiments call for the pockets to also encapsulate corners of a surface material for the game board, or the entire game board 105 itself. Also, the "adherence" may be based on actual adhesives (e.g., glue), or may be sewn on, stapled on, or made as an integral component of the game board surface.

FIG. 5B illustrates one alternative configuration of a page-retaining corner member 101, namely where a surface material 106 of the board 105 (e.g., a vinyl covering on a cardboard base) is split/cut to form an insert 114, so as to create a pocket (slot) between the surface material 106 and the game board 105, such that the game page 120 may be slid through the split and into the insert 114 (i.e., underneath the corner of the surface material 106). The surface material may be split/cut prior to being mounted/adhered to the game board, or may be sliced/cut in place (after being mounted/adhered to the game board).

FIG. 5C illustrates still another alternative configuration of the page-retaining corner members, where bands 116 (e.g., elastic, nylon, etc.) may be arranged to hold the game pages 120 in place on the board 105. Namely, the bands 116, which may be attached to the surface of the game board 105, the edge of the game board, or may go around the corner of the game board, may stretch sufficiently to allow passage of the game pages 120 underneath the band, such that the band then contracts and secures the pages against the surface of the game board accordingly.

Note that the shapes of the corner members are shown as generally triangular, however other shapes and sizes may be used herein, squares, rectangles, semi-circles, quarter circles, "L" shaped corners, etc. Furthermore, while certain configurations are shown for the corners, such as fully encapsulating pockets 112, bands 116 that allow the corner of the game page to be seen once passed through, and so on, such configurations are merely examples, and other arrangements may be made to secure the corners of the game pages, accordingly. Additionally, while pockets, inserts, and bands are shown herein, other securing mechanisms may be used herein, such as clips, and those mentioned specifically herein are not meant to limit the scope of the embodiments herein.

Figure 6:
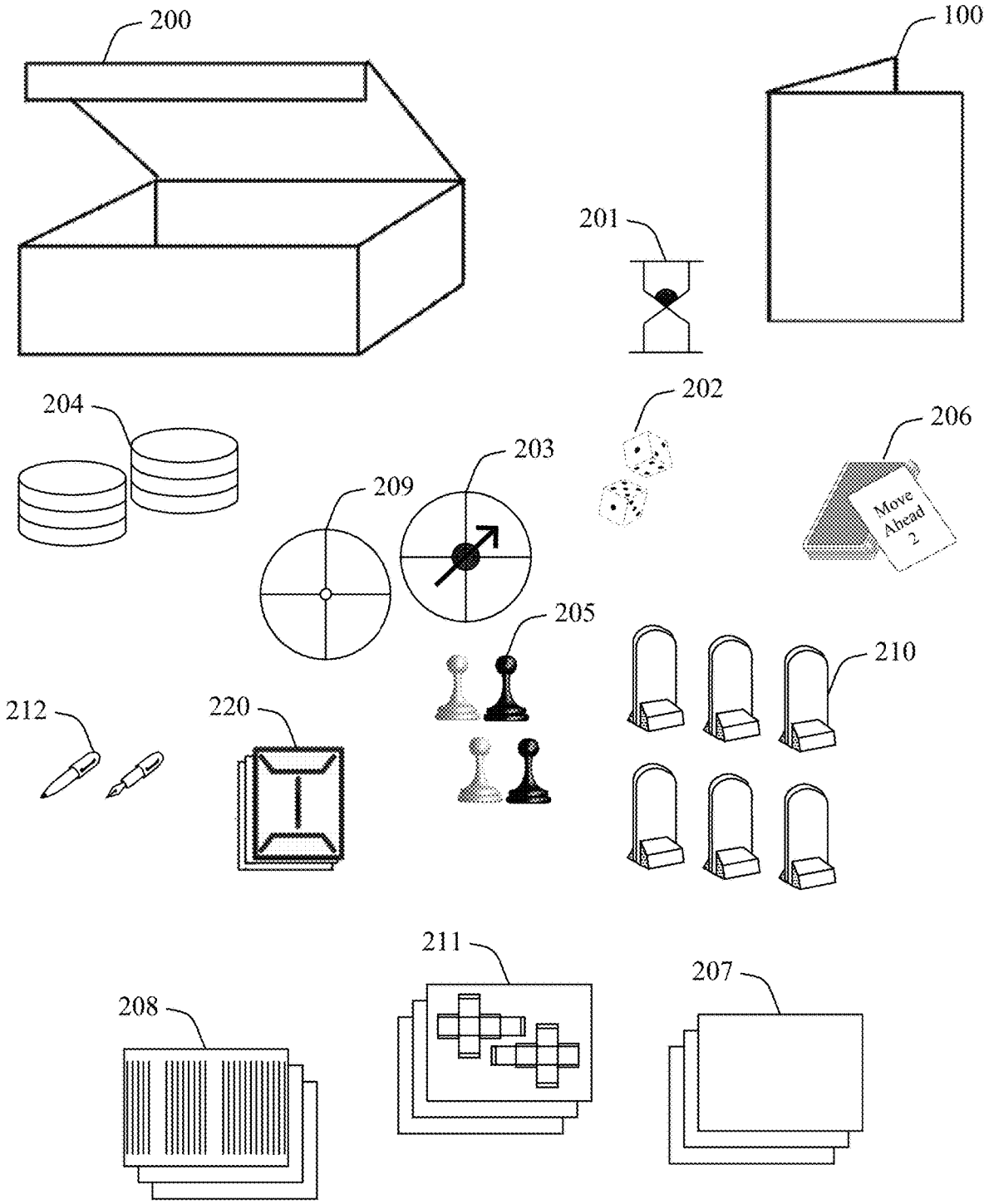
FIG. 6 illustrates an example of a reconfigurable board game kit in accordance with one or more embodiments of the present disclosure.

In accordance with one or more embodiments of the present disclosure, the board game board 100 may be contained within a reconfigurable board game kit. For instance, FIG. 6 illustrates an example of a reconfigurable board game kit 200 that may comprise a plurality of different reusable (e.g., generic and shared) game pieces, such that many different designed or printed games can make use of the same kit items (and board 100), within a shared box (labeled as the "kit" 200). For example, different standard components may comprise one or more timers 201 (e.g., sand timers, digital timers, etc.), one or more dice 202 (e.g., standard six-sided dice), spinners 203 (with preset numbers/actions), tokens/coins/chips 204, pawns 205 (player pieces), cards 206 (pre-marked for gameplay, such as "move ahead two", "go back one", or "trade with another player"), and so on.

In another embodiment, the board game kit further comprises blank and/or templated items to be filled in. For example, blank game pages 207 (panels) (e.g., printer paper, construction paper, cardstock, cardboard, etc.) can be included (to create—draw your own game), and/or games in outlined form (like coloring book pages) to merely color in with your own choices and artistic talent. Additionally, blank rule templates 208 (e.g., "goal", "how to set up", "how to move", and "how to win" sections with blank lines to fill in) may be included, as can blank cards, blank spinner cards 209 (e.g., moving the spinning arrow component between cards depending on the game being played), pawn blanks and pawn holders/stands/bases 210, blank dice or "cut-out and fold" templates 211 (for customized dice), and so on. Various colors of pens, markers, crayons, or pencils (collectively 212) may also be included in the kit to allow a purchaser to get started right away.

Other items, whether standard shared game pieces or blanks/templates for customized games can be used herein, such as, for example, stamps, stickers, money, etc., and those shown and/or mentioned herein are merely demonstrating both the shared reusability of components, as well as the creative (and guided) customization of components that may be contained with the kit 200 herein.

Furthermore, the illustrative kit 200 may also comprise a number of envelopes 220 (packets) and/or other containers to store the panels/pages of each individual board game, its corresponding rules, and any customized (generally non-generic/reusable) game pieces, such that the game board kit can store a number of different games in a single smaller space, by reusing the reconfigurable board game board and the generic game pieces. The resultant packs of games may thus store only the customized (i.e., non-sharable) components needed to play that individual game, such as the game board pages, the rules, specific game pieces, specific game cards, specific game spinners, specific customized game dice, and so on. The remaining components of the kit that can be reused for other games (e.g., generic dice, spinners, pawns, etc.) thus stay out of the individual packs (perhaps in their own "shared pieces packet" or defined dividers within the box), ready to be shared with/used for other games contained within the kit.

Note that the individual game packs (board pages, rules, pieces, etc.) may contain pre-defined games, which may be contained within the original kit, can be purchased in store or online, can be mailed to the users (e.g., as part of a subscription service), or can be printed from online resources. The individual game packs may also be based on a user (or a family of users) who create their own games over time from scratch. Other hybrid methods of creating games are also possible, such as using pre-defined rules but drawing your own game pages and/or making your own customized pieces, taking a pre-drawn game board and replacing one or more of the individual pages with your own, and so on. Also, it's worth noting that the game packs may also be transported separately, such as to a friend's house that has the original kit 200, allowing the transported game to be played (with its customized game pages and any customized pieces) without having to bring the entire kit, as the shared components are universally contained in each of the kits.

Figure 7A:
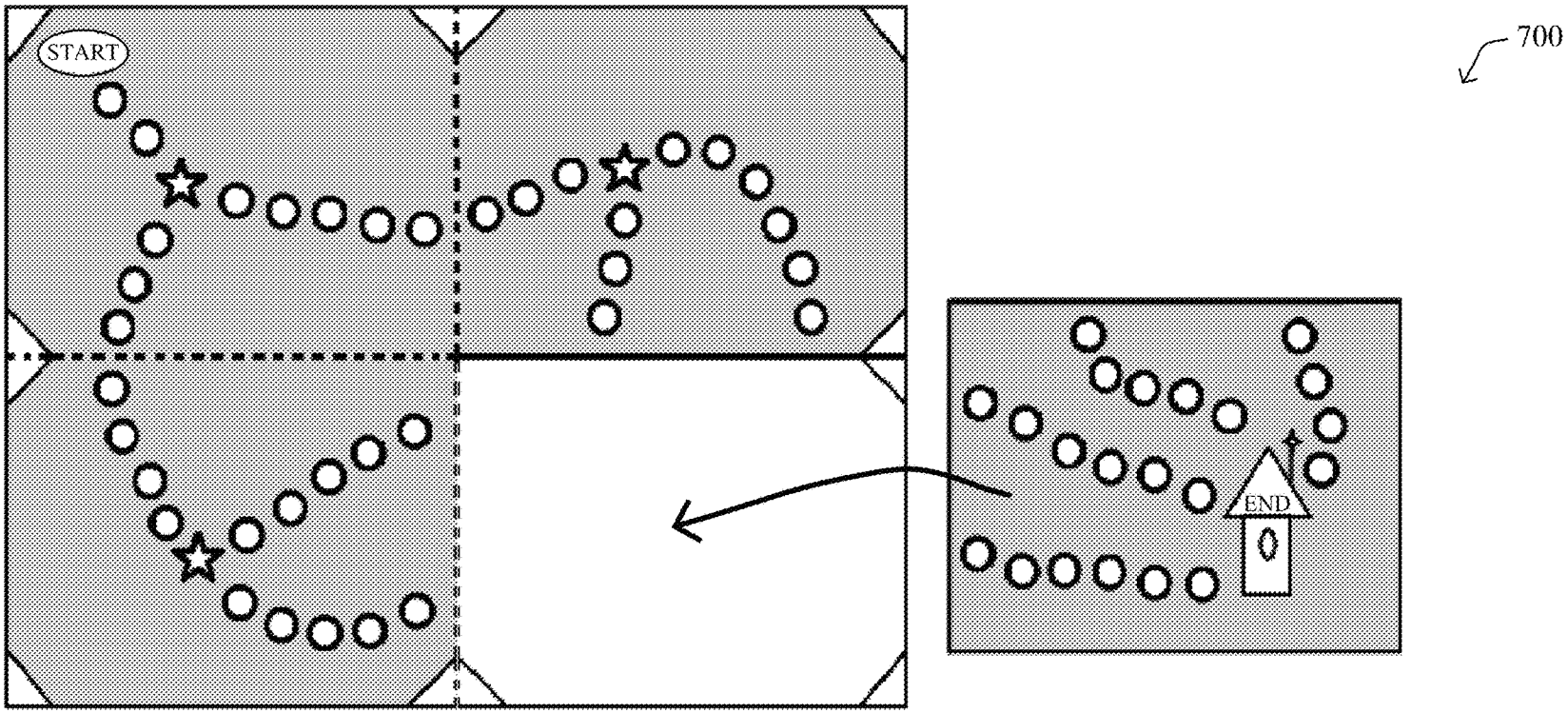
FIGS. 7A-7B illustrate an example of gameplay of a reconfigurable board game board in accordance with one or more embodiments of the present disclosure.
Figure 7B:
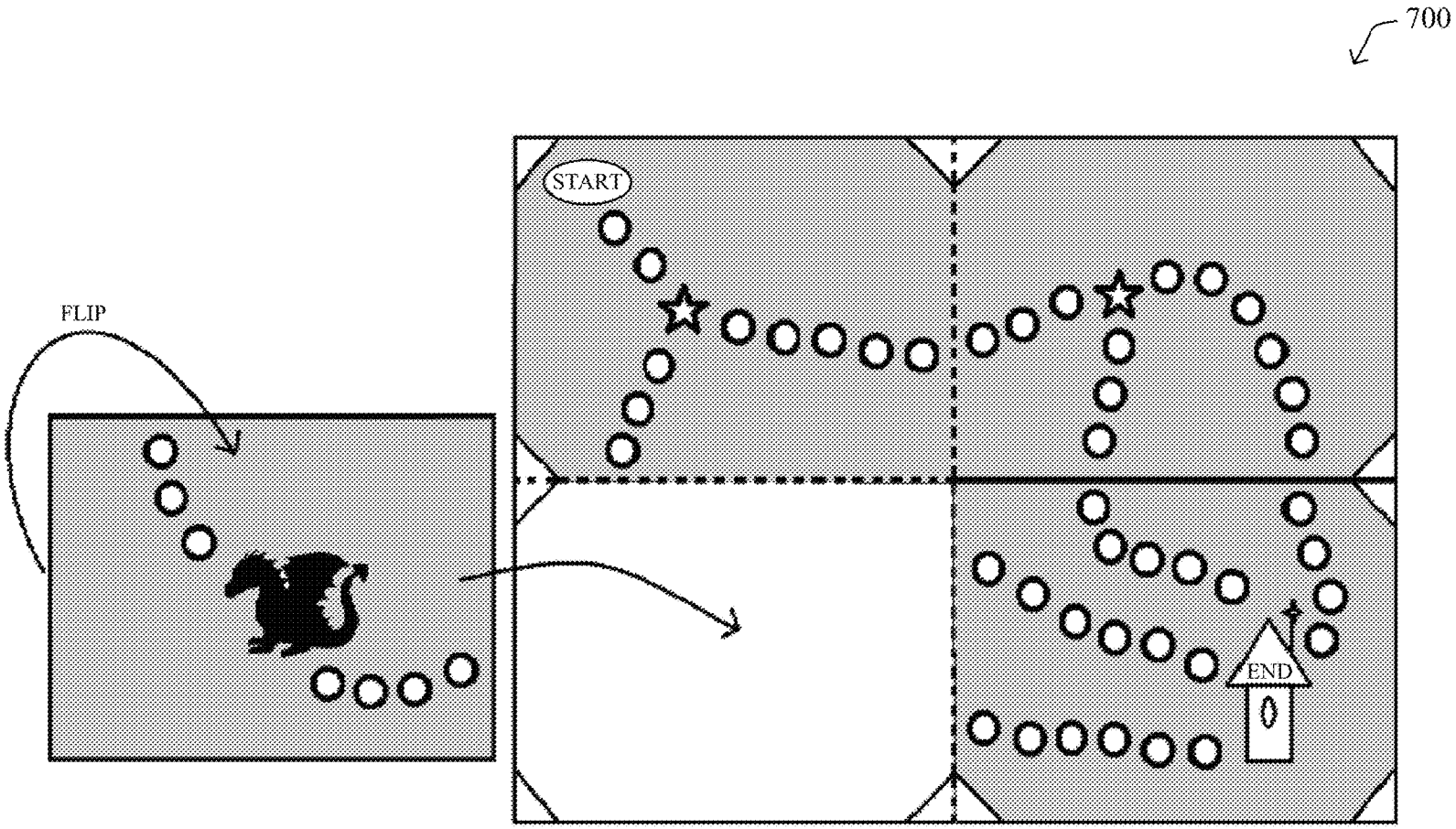

For a demonstration of an example gameplay of the reconfigurable board game system herein, FIGS. 7A-7B illustrate an example of a simple game 700 having four corresponding game pages leading a player from "start" to an "end", with various options along the way. This game may have been pre-designed and purchased (complete or printed), or may have been hand drawn by the players at the time of gameplay or in the past (notably with the paper already inserted on the board or else on a table first). As shown in FIG. 7A, the pages may be inserted onto their respective panels (and into their respective page-retaining corners) to complete the game board. (Note that the flexibility of the game pages, i.e., paper, cardstock, etc., allows the game pages to be inserted into opposing corner members, as may be appreciated by those skilled in the art.) Depending on gameplay rules and configuration, any of the shared and/or customized game pieces may be used to play the game (e.g., standard pawns or customized pawns, customized cards, a spinner, and so on).

Not only does the system herein provide for shared components and customized components, but according to the system herein, a new gameplay flexibility is created herein as well. For instance, as shown in FIG. 7B, games may be created where individual pages (e.g., quadrants) can have two sides or else can be replaced with new sheets, such as changing one specific portion of the game or the entire board. For example, the new portion (flipped, or inserted) may change the map/course of the game, and/or may be associated with a different set of rules (e.g., "moving backwards" or "good vs. evil" sides of a board, etc.). That is, FIG. 7B shows how players can replace or flip a page to change gameplay in an already inserted game.

Figure 8:
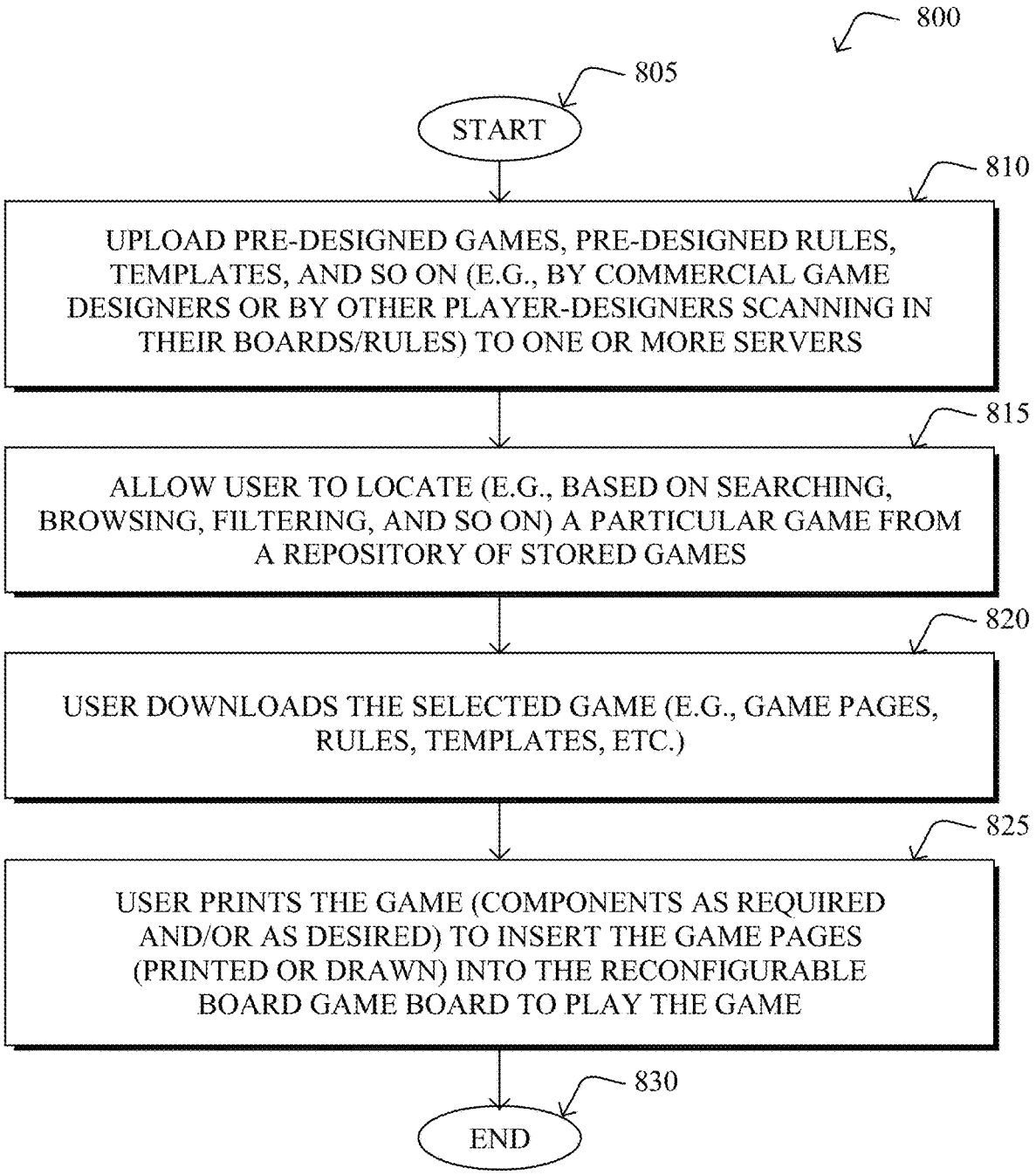
FIG. 8 illustrates an example simplified procedure for software associated with use of a reconfigurable board game system in accordance with one or more embodiments of the present disclosure.

Since there may be an online component to the reconfigurable board game system herein, FIG. 8 illustrates an example simplified procedure for software associated with use of a reconfigurable board game system in accordance with one or more embodiments of the present disclosure. For example, a non-generic, specifically configured device (e.g., a computing device, such as a user device, server, database, web host, etc.) may perform procedure 800 by executing stored instructions (e.g., a process). The procedure 800 may start at step 805, and continues to step 810, where pre-designed games, pre-designed rules, templates, and so on may be uploaded (e.g., by commercial game designers or by other player-designers scanning in their boards/rules) to one or more servers. In one embodiment, the stored games specifically ensure that no gameplay would be located beneath any of the page-retaining corner members when placed on the reconfigurable board game board 100 of the present disclosure. A user may then locate (e.g., based on searching, browsing, filtering, and so on) a particular game from a repository of stored games in step 815, and may download the selected game in step 820. Note that as an option, the user may be allowed to select different color schemes (or "colorization schemes" herein) of the downloaded game board, may choose between color or black/white outlines (coloring book versions), or simply rules to make the entire board from scratch. The user may also select that the server provide or convert the particular page size (e.g., letter versus A4), in order to avoid any scaling issues when printed at the user's home. In step 825 the user may then print the game (e.g., the board, the rules, the templates, custom pieces, etc.), and then can insert the game pages (printed or drawn) into the reconfigurable board game board 100 to play the game. The simplified procedure 800 may then illustratively end in step 830. (Notably, procedure 800 is shown from the user's perspective, but a similar procedure may be told from the perspective of the servers that store the game pages and generate the printable pages, accordingly.)

In closing, the techniques described herein thus advantageously provide for a reconfigurable board game system, particularly that allows for "just add paper" play of countlessly possible games, limited only by imagination (and paper supply). In particular, in addition to fostering creativity, young and old, the system herein can be used to teach collaboration, rule and process creation and description, iterative innovation and improvements, and entrepreneurialism. Still further, the system herein reduces waste and saves space, by reusing not only the game pieces for multiple games, but also reusing the storage box for multiple games. Moreover, since everything needed to create and/or enjoy a game can be included in the system, everyday game designers will find themselves able to produce their own games without having to pilfer materials (e.g., dice, pawns, timers, etc.) from other games, which may then render that supplier game useless unless such materials were returned. Also, the game board itself allows for simple printer or construction paper to be used (e.g., printed and/or drawn on) to create a durable game, as the game pages are held together in place for gameplay, and have the under-support of a solid game board panel surface (i.e., rather than taping paper together and playing on the paper directly on a tabletop or floor).

Notably, unlike other "build your own board game" kits, the system herein may be used to create a new and/or different game time and time again, and allows for creation and use of not only a single game, but as many games as the player desires, in organized packets of individual games. Furthermore, unlike whiteboard game boards, the system herein allows for persistence of created games, meaning they won't erase and can be used again and again, even after using the system for one or more completely different games in between.

In closing, according to one or more embodiments of the present disclosure, an illustrative reconfigurable board game board herein may comprise: a plurality of panels, each of the plurality of panels being planar and having a plurality of corners, each of the plurality of panels interconnected to at least one adjacent panel of the plurality of panels by a corresponding folding interconnection, the plurality of panels being arranged collectively to define a board game board when unfolded; and a plurality of page-retaining corner members, each panel of the plurality of panels having at least one of the plurality of page-retaining corner members at a corresponding corner of that panel, the plurality of page-retaining corner members sized and arranged to allow insertion, retention, and removal of a paper board game page for each of the plurality of panels of the reconfigurable board game board.

In one embodiment, the plurality of panels are arranged collectively as an arrangement selected from a group consisting of: a four-panel tri-fold board game board; a two-panel bi-fold board game board; and a six-paneled board game board.

In one embodiment, when the reconfigurable board game board is folded to establish exposed panel surfaces and interior panel surfaces, the plurality of page-retaining corner members are located on only the interior panel surfaces.

In one embodiment, the plurality of page-retaining corner members are sized and arranged based on the paper board game page being a locally standard printer paper. In one embodiment, the locally standard printer paper is selected from a group consisting of: letter-size 8.5 inches by 11 inches paper; and A4-size 8.25 inches by 11.75 inches paper.

In one embodiment, paper board game pages for the reconfigurable board game board are each individually selected from a group consisting of: drawn-on blank pages; drawn-on templated pages; printed-on pages; purchased pages; single-sided pages; double-sided pages; and laminated paper dry-erase pages.

In one embodiment, the plurality of page-retaining corner members comprise pockets adhered to corners of the plurality of panels.

In one embodiment, the reconfigurable board game board further comprises: a surface material on each panel of the plurality of panels, wherein the plurality of page-retaining corner members comprise cuts into the surface material that form a slot for paper board game page corners to be inserted beneath the surface material.

In one embodiment, the plurality of page-retaining corner members comprise stretching bands.

In one embodiment, the plurality of page-retaining corner members are located only at particular corners of the plurality of panels that are along exterior edges of the reconfigurable board game board when unfolded.

In one embodiment, the plurality of page-retaining corner members are located at each corner of the plurality of panels that are along exterior edges of the reconfigurable board game board when unfolded.

In one embodiment, the plurality of panels are rectangular.

In one embodiment, the plurality of page-retaining corner members are triangular.

Additionally, according to one or more embodiments of the present disclosure, an illustrative reconfigurable board game kit herein may comprise: a reconfigurable board game board, the reconfigurable board game board having a plurality of panels arranged collectively to define a board game board when unfolded, the reconfigurable board game board further having a plurality of page-retaining corner members, each panel of the plurality of panels having at least one of the plurality of page-retaining corner members at a corresponding corner of that panel, the plurality of page-retaining corner members sized and arranged to allow insertion, retention, and removal of a paper board game page for each of the plurality of panels of the reconfigurable board game board; a plurality of generic shared-game components; a plurality of customizable game-specific components; and a box configured to store the reconfigurable board game board, the plurality of generic shared-game components, and the plurality of customizable game-specific components.

In one embodiment, the plurality of generic shared-game components are selected from a group consisting of: generic six-sided dice; generic timers; generic spinners; generic pawns; generic cards; generic tokens; and generic play money.

In one embodiment, the plurality of customizable game-specific components are selected from a group consisting of: customizable blank paper; customizable templated paper; customizable blank cards; customizable pre-formed dice; customizable folding paper dice templates; customizable game pawn blanks and pawn blank stands; rule template paper; and customizable spinner blanks.

In one embodiment, the kit further comprises: one or more customizing components selected from a group consisting of: pens; markers; crayons; pencils; stamps; and stickers.

In one embodiment, the kit further comprises: a plurality of containers configured to store, for each individual customized board game, customized paper board game pages, customized game rules, and customized game components, wherein the reconfigurable board game board and one or more of the plurality of generic shared-game components remain within the box for reuse by each individual customized board game.

In one embodiment, the plurality of page-retaining corner members are sized and arranged based on the paper board game page being a locally standard printer paper.

In one embodiment, the plurality of page-retaining corner members are selected from a group consisting of: pockets adhered to corners of the plurality of panels; cuts into a surface material that form a slot for paper board game page corners to be inserted beneath the surface material; and stretching bands.

Stull further, according to one or more embodiments of the present disclosure, an illustrative method herein may comprise: storing, on a server, a plurality of pre-designed game-related pages corresponding to a plurality of different board games, wherein the plurality of pre-designed game-related pages are configured for use with a reconfigurable board game board, the reconfigurable board game board having a plurality of panels arranged collectively to define a board game board when unfolded, the reconfigurable board game board further having a plurality of page-retaining corner members, each panel of the plurality of panels having at least one of the plurality of page-retaining corner members at a corresponding corner of that panel, the plurality of page-retaining corner members sized and arranged to allow insertion, retention, and removal of a paper board game page for each of the plurality of panels of the reconfigurable board game board, wherein the plurality of pre-designed game-related pages are configured to have no printed gameplay component hidden beneath the plurality of page-retaining corner members; determining, by the server, a user-based selection of a particular pre-designed game-related page from the plurality of pre-designed game-related pages; generating, by the server, a user-printable customized page of the particular pre-designed game-related page; and providing, from the server, the user-printable customized page to a user computer to cause user-based printing of the user-printable customized page for use with the reconfigurable board game board.

In one embodiment, the method further comprises: determining, by the server, a user-based selection for a particular colorization scheme for the particular pre-designed game-related page; and generating, by the server, the user-printable customized page of the particular pre-designed game-related page based on the particular colorization scheme.

Illustratively, aspects of the techniques described herein may be performed by hardware, software, and/or firmware, such as in accordance with the a specifically configured process, which may include computer executable instructions executed by a processor to perform functions relating to the techniques described herein, e.g., in conjunction with other devices which may have a correspondingly configured processes depending upon the functionality of the device, as described herein (e.g., a user device, a web server, an application server, and so on).

In particular, a computer network is a distributed collection of nodes (e.g., transmitters, receivers, transceivers, etc.) interconnected by communication links and segments for transporting signals or data between the nodes, such as personal computers, workstations, mobile devices, servers, routers, or other devices. Many types of computer networks are available, including, but not limited to, local area networks (LANs), wide area networks (WANs), cellular networks, broadband networks, infrastructure or backhaul networks, public switched telephone networks (PSTNs), and many others.

Figure 9:
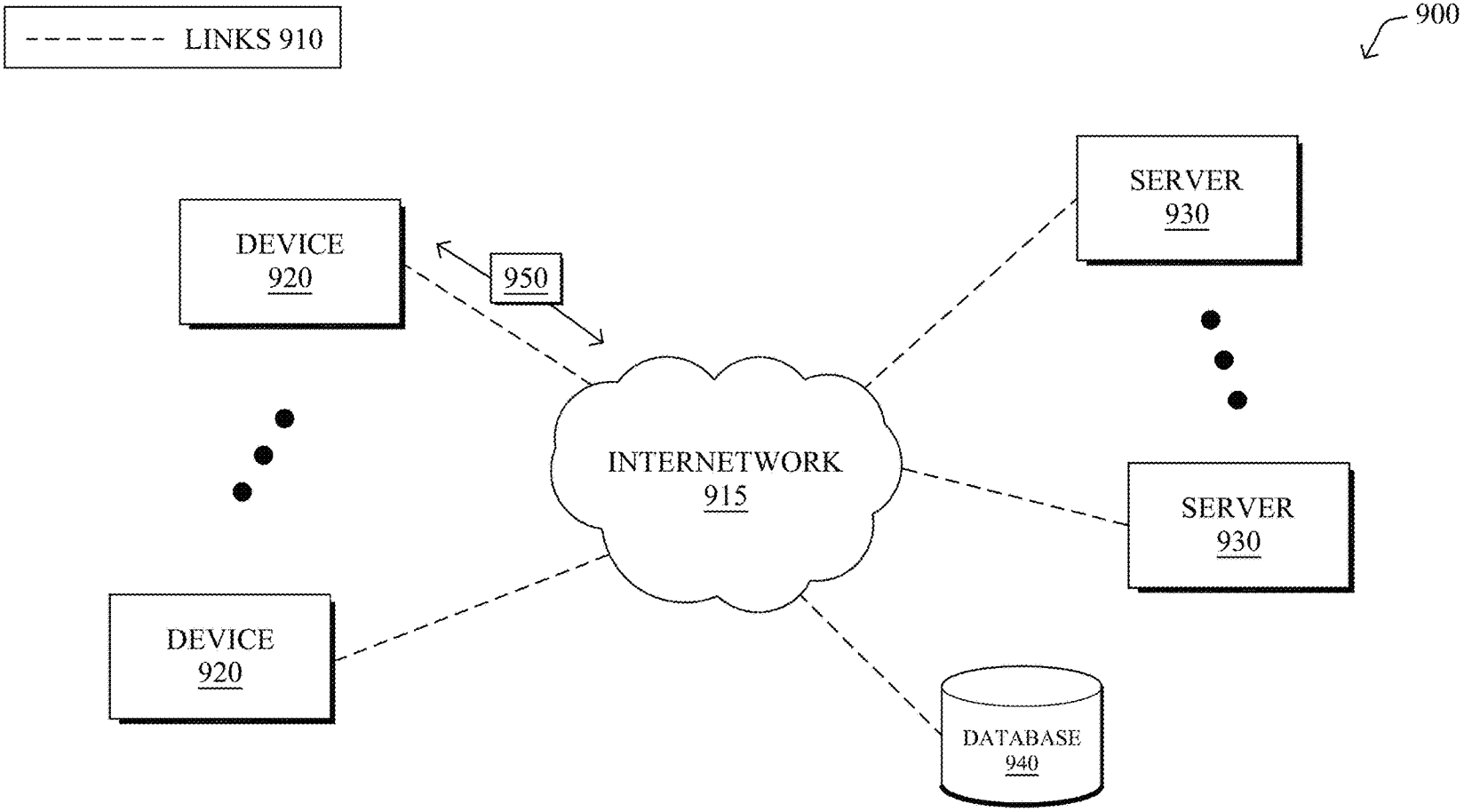
FIG. 9 illustrates an example simplified computer network in accordance with one or more embodiments of the present disclosure.

FIG. 9 illustrates an example, and simplified, computer network 900. As shown, computer network 900 may contain various devices communicating over links 910 and an internetwork 915, such as end devices 920, servers 930, databases 940 (which may be part of servers 930 or in communication with and under the control of servers 930), and other devices as will be appreciated by those skilled in the art. Data transmissions 950 (e.g., packets, frames, messages, transmission signals, etc.) may be exchanged among the nodes/devices of the computer network 900 using predefined communication protocols where appropriate over links 910. In this context, a protocol consists of a set of rules defining how the nodes interact and exchange information with each other.

Notably, the computer network 900 may comprise various individual networks intercommunicating with each other, such as LANs, WANs, cellular/LTE networks, PSTN, and so on, and may include any number of wired or wireless links between the devices, accordingly. Note also that while links 910 are shown generically interconnecting with the internetwork 915, any number of intermediate devices (e.g., routers, switches, firewalls, etc.) may actually make up the composition of the network 900 and internetwork 915, and the view shown herein is merely a simplified illustration.

End devices 920 may comprise different types of devices, such as, e.g., personal computers, desktop computers, laptop computers, mobile devices, tablets, smartphones, wearable electronic devices (e.g., smart watches), smart televisions, set-top devices for televisions, workstations, smart vehicles, terminals, kiosks, applications running on such devices, and so on.

Servers 930 and/or databases 940 may comprise singular servers and/or databases, server and/or database farms, cloud-based server and/or database services, network attached storage (SAN), and any other type or configuration of computing devices that provides computing and/or storage services as will be appreciated by those skilled in the art. Servers 930 and/or databases 940 may be centralized (i.e., processing and/or storage occurring on a single device or within a single location of devices) or distributed/decentralized (i.e., processing and/or storage occurring across multiple devices or across a plurality of locations). Notably, for example, servers 930 and/or databases 940 may be deployed on the premises of an enterprise or may be cloud-based.

Figure 10:
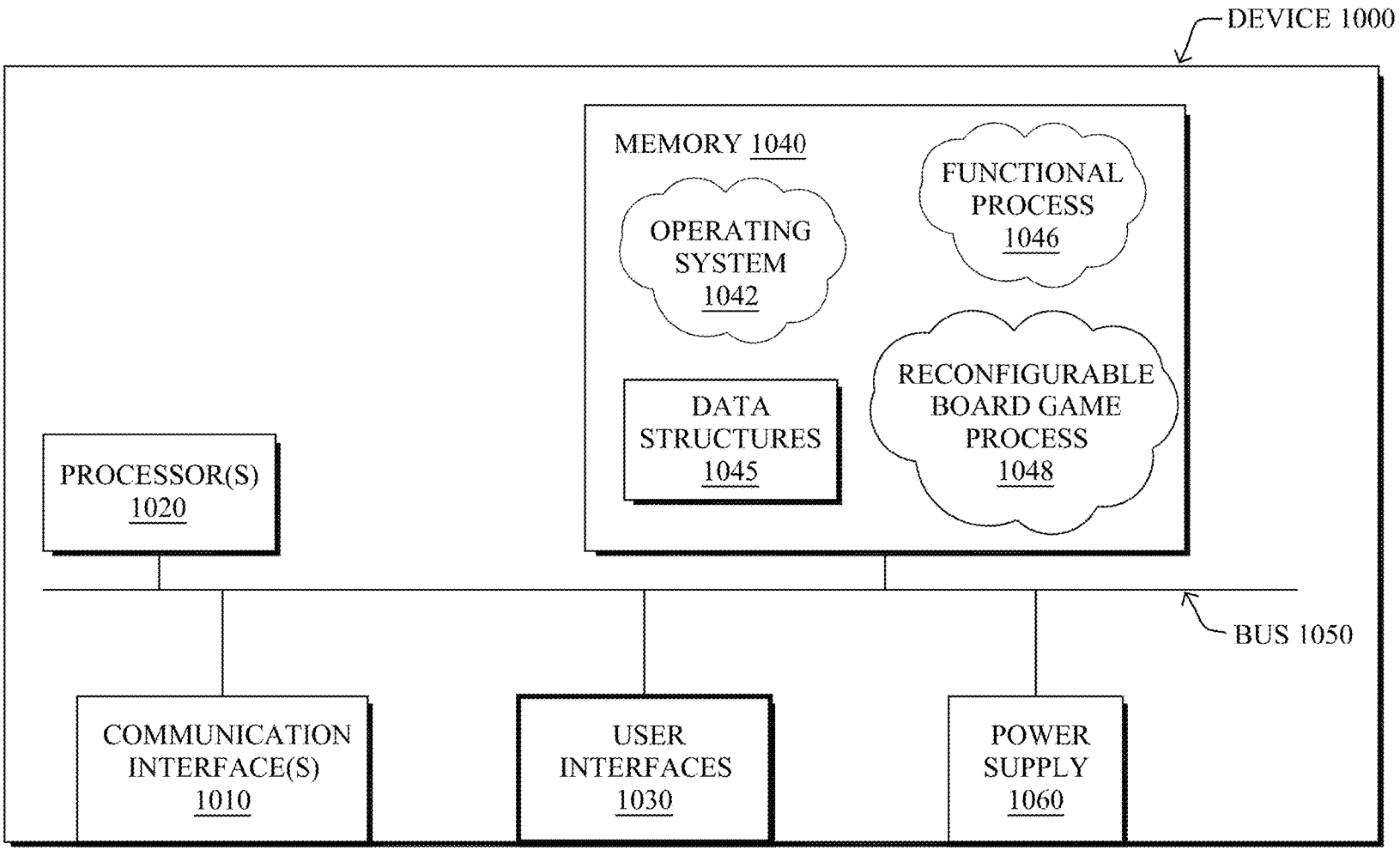
FIG. 10 illustrates an example of a computing device in accordance with one or more embodiments of the present disclosure.

FIG. 10 is a simplified schematic block diagram of an example computing device 1000 that may be used with one or more embodiments described herein (e.g., end device 920, sever 930, database 940, etc.). Illustratively, device 1000 may generally include one or more communication interfaces 1010, one or more processors 1020, and a memory 1040 interconnected by a system bus 1050 or other dedicated circuitry, and is powered by a power supply system 1060. Additionally, the device 1000, where required, may comprise one or more user interfaces 1030 configured to solicit and receive user input (input/output or "I/O" components, such as displays, keyboards, touchscreens, biometrics, and so on).

The communication interfaces 1010 include the mechanical, electrical, and signaling circuitry for communicating data over wired and/or wireless links of a communication network.

The memory 1040 includes a plurality of storage locations that are addressable by the processor(s) 1020 for storing software programs and data structures associated with the embodiments described herein. The processor(s) 1020 may comprise necessary elements or logic adapted to execute the software programs and manipulate the data structures 1045. An operating system 1042, portions of which are typically resident in memory 1040 and executed by the processor(s) 1020, functionally organizes the device by, among other things, invoking operations in support of software processors and/or services executing on the device. Illustratively, these software processes and/or services may include one or more functional processes 1046 (e.g., specific to functionality of the device), and an example "reconfigurable board game" process 1048 that is configured to perform one or more of the operations described herein.

It will be apparent to those skilled in the art that other processor and memory types, including various computer-readable media, may be used to store and execute program instructions pertaining to the techniques described herein. Also, while the description illustrates various processes, it is expressly contemplated that various processes may be embodied as modules configured to operate in accordance with the techniques herein (e.g., according to the functionality of a similar process). Further, while processes may be shown and/or described separately, those skilled in the art will appreciate that processes may be routines or modules within other processes.

While there have been shown and described illustrative embodiments, it is to be understood that various other adaptations and modifications may be made within the scope of the embodiments herein. For example, while certain types of game board folding designs and/or materials, certain game pieces, certain templates, and so on have been specifically mentioned herein, those skilled in the art will recognize that the reconfigurable board game system described herein is not so limited, and that other designs, materials, pieces, templates, etc. may be used in accordance with the techniques described herein, and those specifically mentioned are merely examples not meant to limit the scope of the present disclosure. Also, while certain protocols, device types, and configurations may have been illustrated above, others may also be used as appropriate, accordingly.

Moreover, while the present disclosure contains many other specifics, these should not be construed as limitations on the scope of any embodiment or of what may be claimed, but rather as descriptions of features that may be specific to particular embodiments of particular embodiments. Certain features that are described in this document in the context of separate embodiments can also be implemented in combination in a single embodiment. Conversely, various features that are described in the context of a single embodiment can also be implemented in multiple embodiments separately or in any suitable sub-combination. Further, although features may be described above as acting in certain combinations and even initially claimed as such, one or more features from a claimed combination can in some cases be excised from the combination, and the claimed combination may be directed to a sub-combination or variation of a sub-combination.

For instance, while certain aspects of the present disclosure are described in terms of being performed "by a server" or "by an application," those skilled in the art will appreciate that portions of the platform herein may be considered to be extensions of the server operation performed by the application, or extensions of the application operation performed by the server, and as such, any process step "performed by" one process or another need not be limited to local processing on a specific device, unless otherwise specifically noted as such. Furthermore, while certain aspects are described as being performed "by a process" or by particular types of components, the techniques may be generally applied to any suitable software/hardware configuration as part of an apparatus or otherwise.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in the present disclosure should not be understood as requiring such separation in all embodiments.

In particular, it should be noted that the steps shown and described in the procedures herein are merely examples for illustration, and certain other steps may be included or excluded as desired. For instance, other steps may also be included generally within procedures above as described herein. For example, such steps (whether additional steps or furtherance of steps already specifically illustrated above) may include such things as: manufacturing the reconfigurable board game board, translating uploaded games prior to their download, censoring/filtering games before upload and/or download (e.g., age-based), providing online playable games, converting uploaded games into online playable games, converting uploaded color games into black-and-white outlined game templates, distributing updated game boards/rules to previous downloaders, entering or receiving comments on better gameplay (e.g., revisions for better play, different play, continued play, etc.), and so on. Further, while a particular order of the steps is shown, this ordering is merely illustrative, and any suitable arrangement of the steps may be utilized without departing from the scope of the embodiments herein. Also, while procedures may be described separately, certain steps from each procedure may be incorporated into each other procedure, and the procedures are not meant to be mutually exclusive.

The foregoing description has been directed to specific embodiments. It will be apparent, however, that other variations and modifications may be made to the described embodiments, with the attainment of some or all of their advantages. For instance, it is expressly contemplated that certain components and/or elements described herein can be implemented as software being stored on a tangible (non-transitory) computer-readable medium (e.g., disks/CDs/RAM/EEPROM/etc.) having program instructions executing on a computer, hardware, firmware, or a combination thereof. Accordingly this description is to be taken only by way of example and not to otherwise limit the scope of the embodiments herein. Therefore, it is the object of the appended claims to cover all such variations and modifications as come within the true intent and scope of the embodiments herein.

What is claimed is:

1. A reconfigurable board game system, comprising:

a game board including a plurality of panels formed in a two-by-two arrangement with each panel being rectangular and being interconnected to at least one adjacent panel of the plurality of panels by a folding interconnection, wherein the game board forms a folded configuration and an unfolded configuration, and a plurality of triangular-shaped page-retaining corner members are positioned on each of the plurality of panels, wherein each panel includes only three page-retaining corner members that are located proximate an exterior edge of the game board in the unfolded configuration such that an interior surface area of the game board is unobstructed from any of the plurality of triangular-shaped page-retaining corner members; and a plurality of board game pages removably retained by the plurality of triangular-shaped page-retaining members on each of the plurality of panels, wherein the plurality of board game pages may be reconfigured from a first game board design to a second game board design.

* * * * *